United States Patent [19]

Saigo et al.

[11] Patent Number: 4,582,499

[45] Date of Patent: Apr. 15, 1986

[54] MOTION TOY

[75] Inventors: Hiroshi Saigo, Kasukabe; Takashi Suzuki, Tokyo, both of Japan

[73] Assignee: Iwaya Corporation, Tokyo, Japan

[21] Appl. No.: 556,461

[22] Filed: Nov. 30, 1983

[30] Foreign Application Priority Data

Dec. 9, 1982 [JP] Japan ..... 57-215730

[51] Int. Cl.[4] ..... A63H 3/24; A63H 11/00; A63H 3/02

[52] U.S. Cl. ..... 446/304; 446/352; 446/372

[58] Field of Search ..... 446/304, 297, 298, 303, 446/304, 330, 352, 353, 369, 371, 372, 391, 395

[56] References Cited

U.S. PATENT DOCUMENTS

| | | | |
|---|---|---|---|
| 2,631,408 | 3/1953 | Henry | 446/304 |
| 3,229,421 | 1/1966 | Ostrander | 446/304 |
| 3,383,795 | 5/1968 | Ryan et al. | 446/304 |
| 3,600,851 | 8/1971 | Nielsen | 446/436 |
| 3,851,418 | 12/1974 | Barlow et al. | 446/321 |
| 3,858,352 | 1/1975 | Cummings et al. | 446/305 |
| 3,964,205 | 6/1976 | Kuramochi | 446/343 X |
| 4,033,071 | 7/1977 | Strongin et al. | 446/304 |
| 4,074,460 | 2/1978 | Thorn et al. | 446/304 |
| 4,192,092 | 3/1980 | Goldfarb et al. | 446/304 |
| 4,245,429 | 1/1981 | Katzman et al. | 446/391 X |
| 4,389,811 | 6/1983 | Iwaya et al. | 446/298 X |

*Primary Examiner*—Robert A. Hafer
*Assistant Examiner*—D. Neal Muir
*Attorney, Agent, or Firm*—James E. Nilles

[57] ABSTRACT

A motion toy consists of a toy body and a power feeder. The toy body contains a driving mechanism for driving a movement mechanism and a fixed terminal on one side thereof. The power feeder is provided independently of the toy body and formed in a desired shape and has a connection terminal which can be detachably connected to the fixed terminal. The driving mechanism for driving the movement mechanisms is provided within the head of the toy body, and the fixed terminal is arranged within the mouth of the toy. The power feeder is shaped like a feeding bottle containing batteries, and the connection terminal thereof is shaped like the mouthpiece of the feeding bottle.

6 Claims, 10 Drawing Figures

MOTION TOY

BACKGROUND OF THE INVENTION

1. Field of the Invention

This invention relates to a motion toy shaped like a relatively small animal such as a rabbit, mouse, or squirrel which can be cuddled and made to act in a predetermined manner.

2. Description of the Prior Art

Various types of motion toys shaped like animals have been proposed, most of them contain a driving mechanism for driving moving parts and batteries for supplying power to the driving mechanism. A toy thus constructed can be made to walk, nod, mew, wag its tail, and so on.

For this reason, the whole body of the toy is covered with a covering to give it the feel of an animal externally. However, because a hard frame containing the driving mechanism and battery is covered by only a thin covering, the toy feels hard to the touch and does not give the soft impression of an animal when held. Moreover, the total size of the toy is inevitably large because of the battery case holding the battery; it is extremely difficult to make a small toy which can mimic the motions of a small animal or a baby thereof.

SUMMARY OF THE INVENTION

The present invention has been devised in the light of these problems. An object of the present invention is to provide a motion toy with a power feeder which is independent of a toy containing a driving mechanism for driving moving parts and which is used to supply power to the driving mechanism so that the whole body of the toy can be made as compact as required, while the portions by which the toy is held are made soft to the touch in such a manner that the toy feels like an animal when it is designed in imitation of the animal.

The motion toy in accordance with the present invention comprises a toy body containing a driving mechanism which drive moving parts and has a fixed terminal on one side, and a power feeder provided independently of the toy and which is equipped with a detachable connection terminal in a desired form that can be electrically connected to the fixed terminal, and the toy is characterized in that power can be supplied to the driving mechanism to drive the moving parts by electrically connecting, when necessary, the feeder to the toy by the connection and fixed terminals.

Other and further objects, features and advantages of the present invention will become clearly from the following description.

BRIEF DESCRIPTION OF THE PREFERRED EMBODIMENTS

Figure 1:
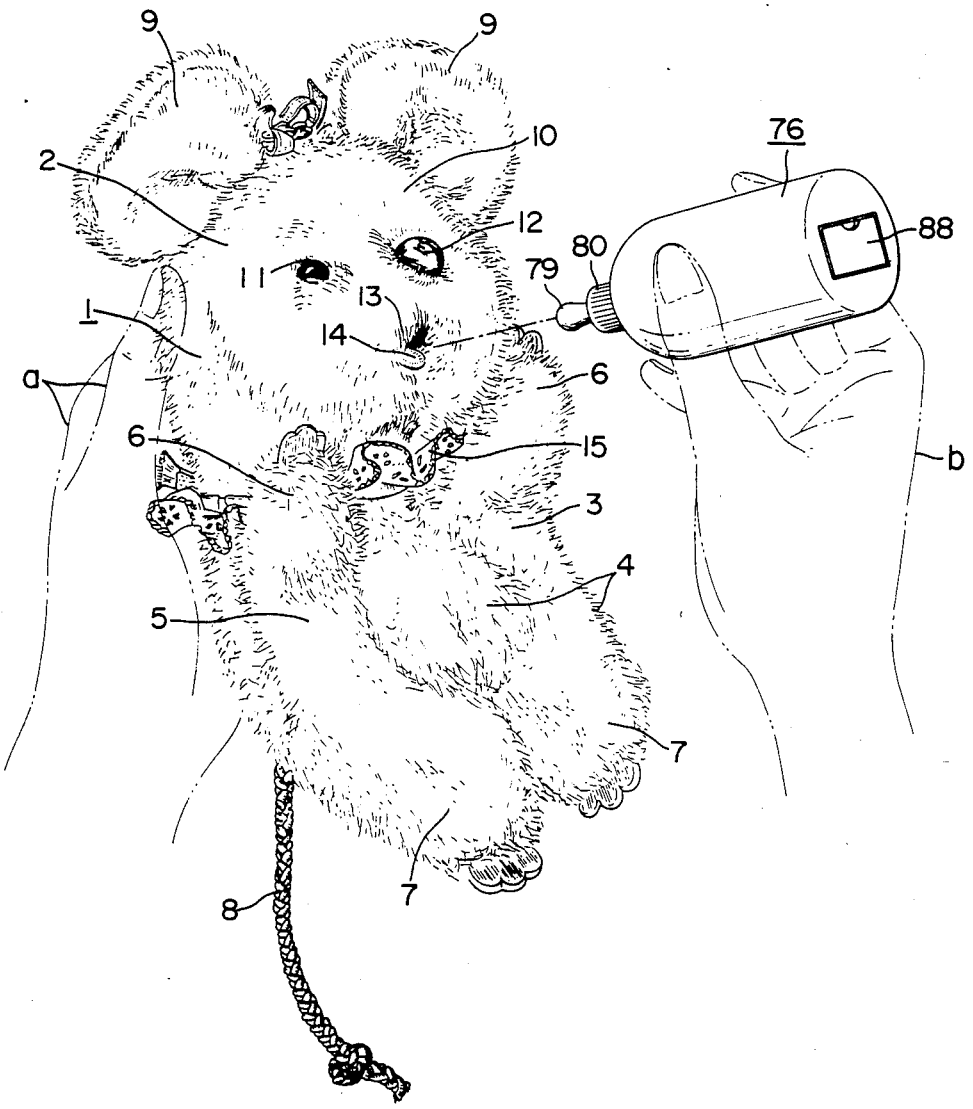
FIG. 1 is a schematic view of a motion toy.
Figure 2:
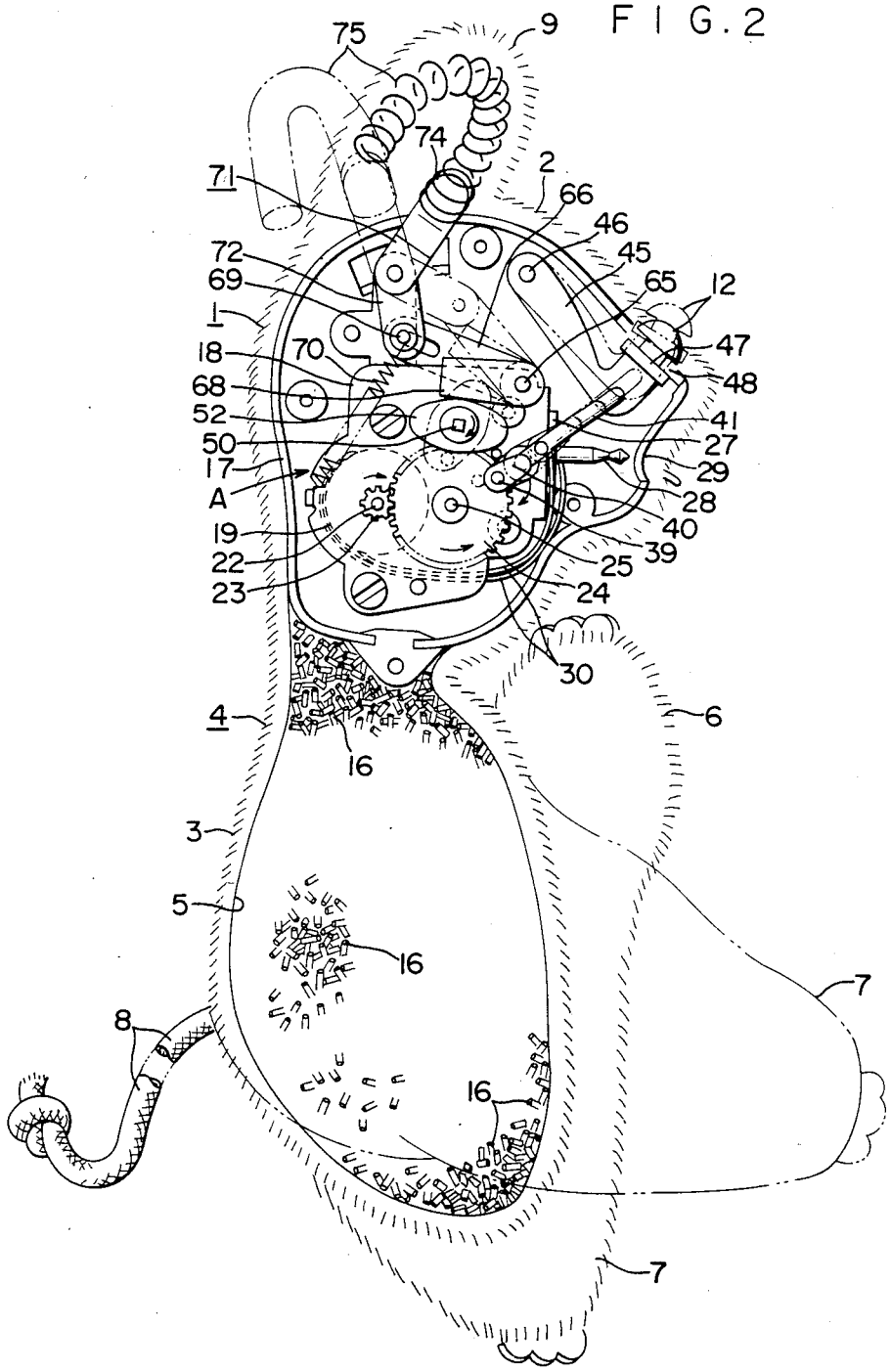
FIG. 2 is a vertical view of the motion toy viewed from one side.
Figure 3:
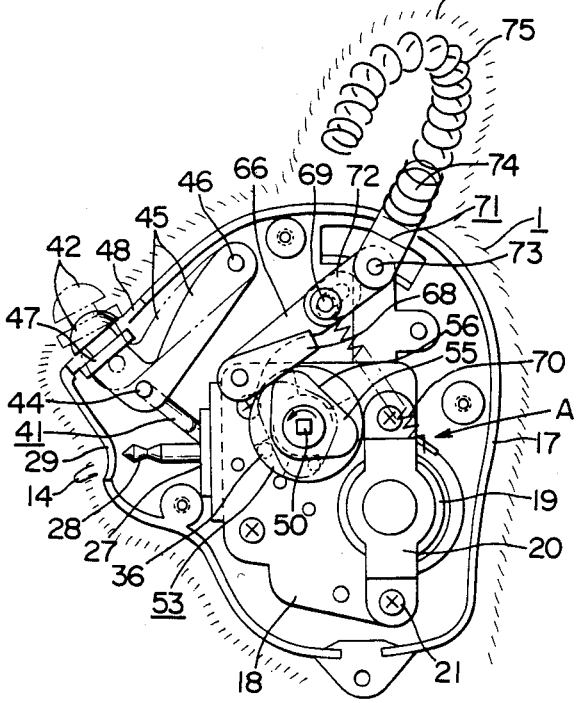
FIG. 3 is a vertical view of the motion toy viewed from the other side.
Figure 4:
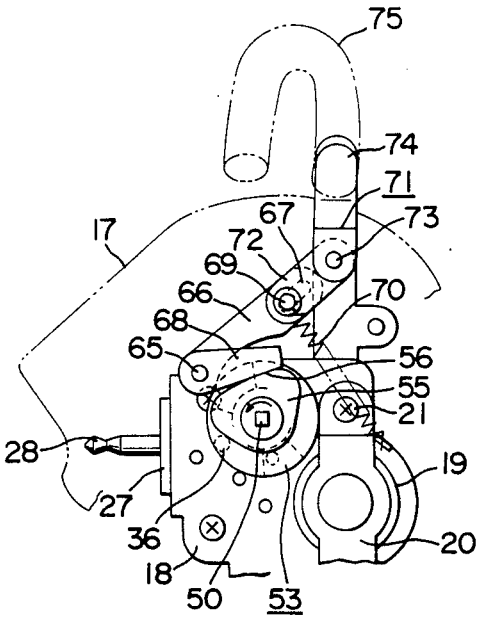
FIGS. 4 and 5 are schematic views of the operation of the driving mechanism thereof.
Figure 5:
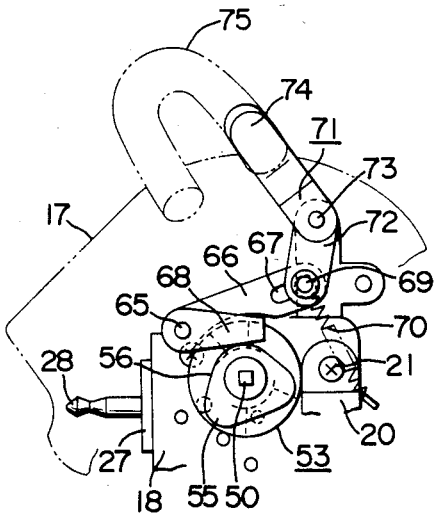
Figure 6:
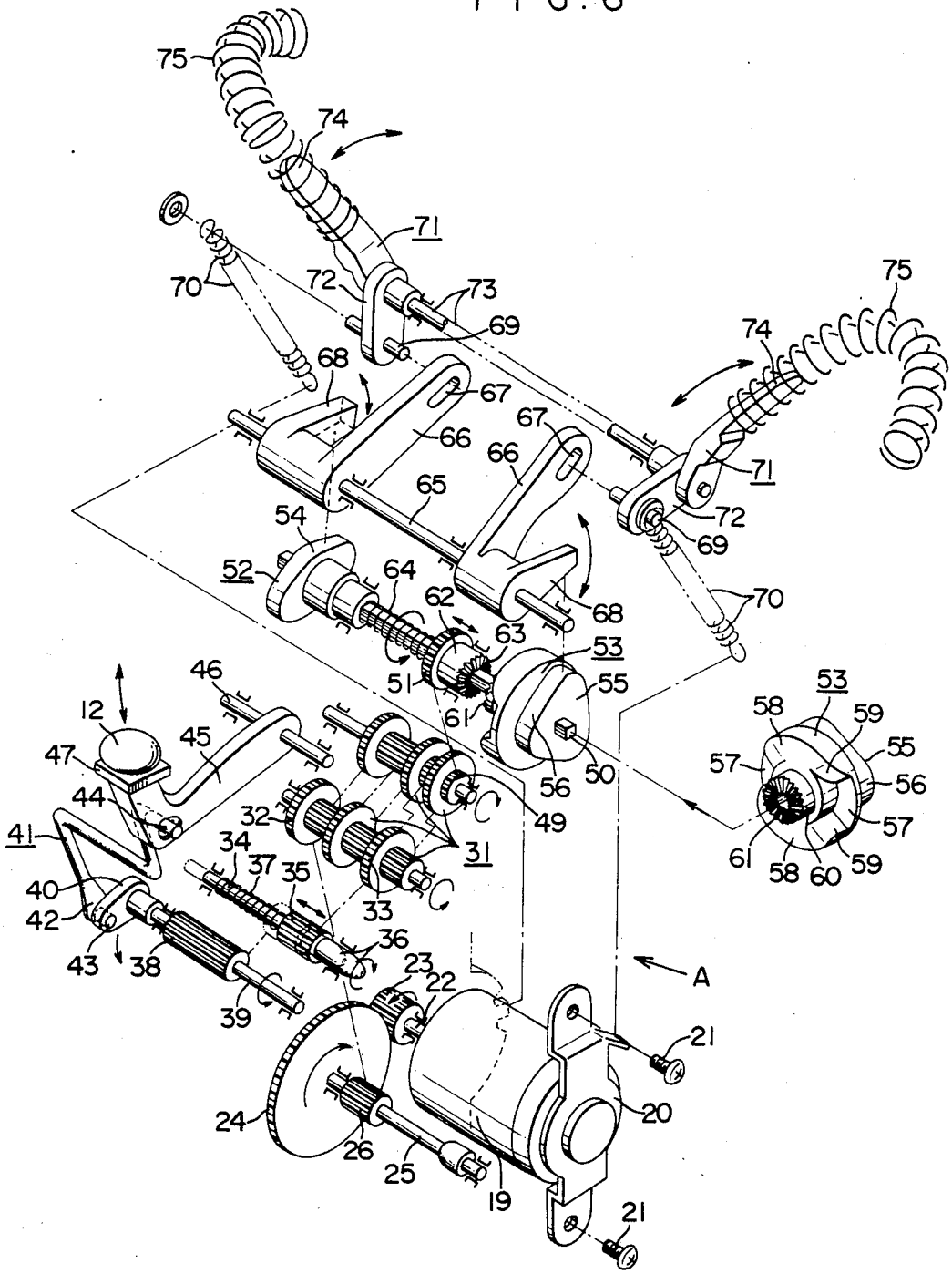
FIG. 6 is an exploded schematic view of the driving mechanism thereof.
Figure 7:
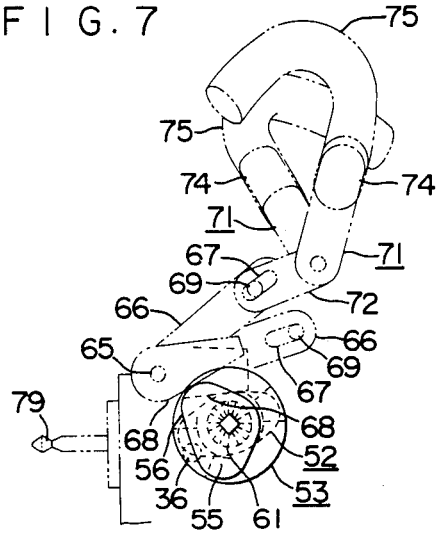
FIG. 7 is an external view of the cam plate viewed from one side of the driving mechanism thereof.
Figure 9:
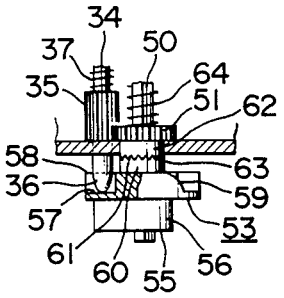
FIG. 9 is a partially sectioned top view of the cam plate engaging with a sliding shaft.
Figure 8:
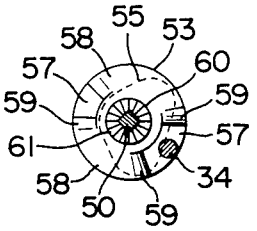
FIG. 8 is an internal side view of the cam plate of the driving mechanism thereof.
Figure 10:
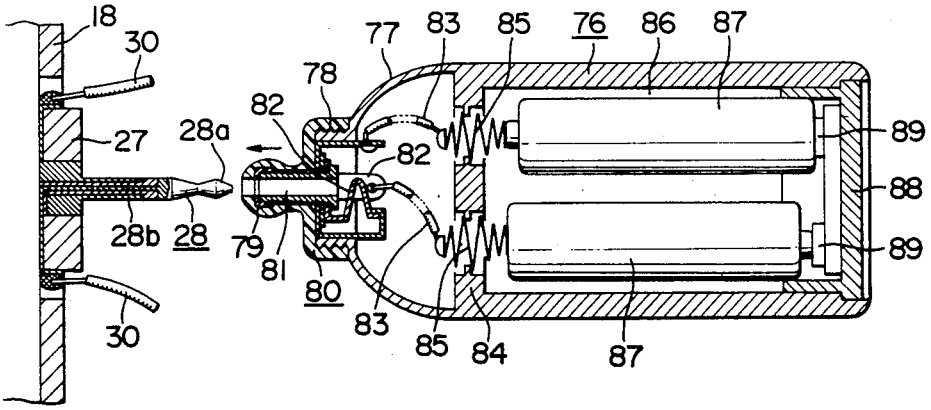
FIG. 10 is a section through the feeder for the fixed terminal.

In the drawings, numeral 1 is a toy shaped like a lovable baby mouse, comprising a head 2 and a napped coat 4 covering the head and forming a body 3. The napped coat 4 is so napped that it feels like an animal and the portion of the body 3 is formed into a bag 5 with two hands 6 at each side of its upper portion, two legs 7 at each side of its lower end, and a tail 8 in its lower rear portion. The head 2 is provided with ears 9 which are moving parts projecting from the top, eyeballs 11, and a nose 12 which are moving parts on its face 10, and part of a tongue 14 projecting from a mouth 13, and a bib 15 is attached to its neck. The body 3 in the form of the bag 5 and both the legs 7 are filled with a fixed quantity of finely chopped pieces of plastic 16 so that the finely chopped pieces 16 and the napped coat 4 made the toy soft and pliable, and it feels like an animal.

The head 2 is provided with two halves of a head frame 17 in which a mechanism frame 18 is installed, the mechanism frame 18 containing a driving mechanism A for driving the moving parts. A motor 19 provided in the mechanism frame 18 of the driving mechanism is attached thereto by a mounting piece 20 and machine screws 21, a reduction gear 24 engages with a pinion 23 fixed to an output shaft 22 of the motor 19, and a connecting gear 26 is attached to a connecting shaft 25 supporting the reduction gear 24. A fixed terminal 28 with poles 28*a*, 28*b* in front and rear projects from the front panel 27 of the mechanism frame 18, and is arranged in such a manner that it faces an opening 29 corresponding to the mouth 13 in the head frame 17. The fixed terminal 28 is electrically connected to the motor 19 by a lead 30. An input gear 32 of a gear-connecting mechanism 31 engages with the connecting gear 26, and a switching gear 35 on a sliding shaft 34 held by the mechanism frame 18 in such a manner that it is movable in the horizontal direction engages with a first output gear 33 of the gear-connecting mechanism 31. A pressure receiver 36 shaped as a circular arc is formed at one end of the sliding shaft 34, and a coil spring 37 is provided between the mechanism frame 18 and the other end thereof so as to force the sliding shaft 34 to always engage the switching gear 35 with the first output gear 33.

A nose-driving gear 38 to which the switching gear 35 can be removably connected is fixed to a lateral rod 39 rotatably attached to the mechanism frame 18, a crank arm 42 at one end of a crank shaft 41 is rotatably attached to a projecting piece 40 perpendicular to one end of the lateral rod 39 by a coupling shaft 43, and an L-shaped bend of a nose frame 45 is rotatably attached to a crank arm 44 at the other end of the crank shaft 41. The upper end of a vertical portion of the nose frame 45 is rotatably supported by the front upper portion of the head frame 17 through a lateral shaft 46, and the nose 12 projects from the front end of a horizontal portion thereof on top of a holder 47 holding up the napped coat in such a manner that it can poke outward repeatedly through a guide hole 48 made in the nose of the head frame 17.

An input gear 51 for driving shaft 50 of square cross-section which is attached rotatably and horizontally to the mechanism frame 18 engages with a second output gear 49 of the gear-connecting mechanism 31, the input gear 51 is able to rotate and slide along the driving shaft 50. A first cam plate 52 and a second cam plate 53 are attached to either ends of the driving shaft 50. The first cam plate 52 has a rhombic shape with a rhombic peripheral engagement surface 54, whereas the second cam plate 53 is provided with a roughly triangular cam 55 projecting therefrom which has a roughly triangular peripheral engagement surface 56 with rounded corners, the interior thereof being provided with opposing engagement recesses 57 and opposing engagement projections 58 separated by oblique guide surfaces 59, pressing against the pressure-receiver 36 of the sliding shaft 34. A clutch gear 61 is provided on the inner face of a bearing boss 60 projecting from the inside of the second cam plate 53, and a clutch gear 63 engaging with and disengaging from the clutch gear 61 as it moves forward and backward is provided on the outer face of a bearing boss 62 projcting outward from the input gear 51. A coil spring 64 is wound around the driving shaft 50 between the input gear 51 and the first cam plate 52, and the input gear 51 is energized in the axial direction by the coil spring 64 so that the clutch gear 63 is made to engage with the clutch gear 61 of the second cam plate 53.

A support shaft 65 is held laterally by the mechanism frame 18, and the bases of two operating pieces 66 are supported by the shaft 65 in such a way that they are movable upward and downward. Guide slots 67 are made in the outer ends of both operating pieces 66 in the longitudinal direction, and the outer portions of the bases have projecting engagement pieces 68 facing the engagement surfaces 54, 56 of the first cam plate 52 and the second cam plate 53, respectively. Coil springs 70 are stretched between the mechanism frame 18 and two lateral shafts 69, each of the shafts 69 being rotatably inserted in the guide slot 67 of the corresponding operating piece 66, and the coil springs 70 are used to engage the engagement pieces 68 with the corresponding engagement surfaces 54, 56.

Connecting projections 72 of ear frames 71 are rotatably attached to the lateral shafts 69 inserted in the guide slots 67 of the operating pieces 66, and the ear frames 71 are rotatably attached to the ends of a shaft 73 horizontally mounted in rear upper end portions of the mechanism frame 18. The lower ends of curved ear cores 75 made of coil springs are fixed to supporting projections 74 projecting upward from the ear frames 71, and the ear cores 75 are each inserted into the ear 9.

Numeral 76 indicates a power feeder which is shaped like a cylindrical feeding bottle, a screw cylinder 78 having a thread about its periphery projects from the front end of a tapered portion 77 of a circular arc shape at one end of the feeder 76. The front end of the screw cylinder 78 is provided with the base of a detachable cap-shaped terminal body 80 with a connection terminal 79 projecting therefrom, the connection terminal being shaped as a mouthpiece similar to a teat. The connection terminal 79 of the terminal body 80 is provided with a through hole 81 into which the fixed terminal 28 can be inserted, and connection pieces 82 to form electrical connections with the two poles 28*a*, 28*b* of the fixed terminal are provided in the through hole 81. Terminals 85 formed as coil springs fixed to partitions 84 are each connected to the connection pieces 82 through leads 83. One end of each of batteries 87 held within a battery container 86 and arranged in the feeder 76 is connected to the terminal 85, and the other ends of the batteries 87 are connected to movable terminals 89 on a detachable cover 88 at the other end of the feeder 76. The batteries 87 and the motor 19 can be connected together electrically and suitably by inserting the fixed terminal 28 into the connection terminal 79 of the feeder 76 through the hole 81.

The operation of the mechanism will now be described.

As shown in FIG. 1, for instance, the child playing with the toy 1 holds it in his left hand. Since the toy 1 is covered with the napped coat 4 and the part of the body 3 that is held is filled with the fine pieces 16 to make it soft and pliable, it feels very like an animal.

Holding the feeder 76 shaped like a feeding bottle in his right hand, he brings the feeder 76 close to the toy 1 and inserts the connection terminal 79 of the feeder 76 into the mouth 13 to connect the terminal 79 to the fixed terminal of the toy 1. By so doing, the batteries 87 of the feeder 76 are electrically connected to the motor 19 provided in the head 2, a switch is turned on, and the motor 19 is started. The gear-connecting mechanism 31 is operated by the motor 19 through the pinion 23 of the output shaft 22, the reduction gear 24, and the connecting gear 26, and the driving shaft 50 is driven by the input gear 51 engaging with the second output gear 49 of the gear-connecting mechanism 31. The rotation of the driving shaft 50 makes the first cam plate 52 and the second cam plate 53 rotate and, through the connection of the engagement pieces 68 and the engagement surfaces 54, 56 of the first and second cam plates 52, 53, both the operating pieces 66 swivel up and down around the support shaft 65 against the forces of the coil springs 70. The two ear frames 71 with the connecting projections 72 linked with the guide slots 67 of both the operating pieces 66 by the lateral shafts 69 swivel up and down about the shaft 73, and the ears of the toy 1 are moved up and down or forward and backward alternately and out of synchronization with each other by the ear cores 75 mounted on the two supporting projections 74 in such a manner that the toy flaps its ears. In other words, since the shapes of the first and second cam plates 52, 53 are different, the ears 9 of the toy 1 move in this way.

The rotation of the cam plate 53 attached to the driving shaft 50 causes the pressure receiver 36 of the sliding shaft 34 sliding on and engaging with one of the inner engagement recesses 57 to run up onto the next engagement projection 58 over one of the oblique guide surfaces 59 so that the sliding shaft 34 gradually slides in the axial direction against the force of the coil spring 37, and the switching gear 35 installed halfway along the sliding shaft 34 engages with the nose-driving gear 38 while it is still engaged and interlocked with the first output gear 33 of the gear-connecting mechanism 31. Consequently, the lateral rod 39 is rotated by the nose-driving gear 38 and the nose frame 45 rotatably linked to the coupling shaft 43 of the projecting piece 40 attached to one end of the lateral rod 39 by the crank shaft 41 moves up and down around the lateral shaft 46, so that the nose 12 attached to the nose frame 45 together with the napped coat 4 also moves up and down, so that the forward and backward movement of the nose 12 makes the nose 12 of the toy 1 expand and contract. Accordingly, while the pressure receiver 36 of the sliding shaft 34 is pushed by the engagement projection 58 of the cam plate 53, the toy 1 moves its nose as if it were breathing in and drinking milk.

As the cam plate 53 rotates further, making the pressure receiver 36 of the sliding shaft 34 run off the engagement projection 58, the sliding shaft 34 is gradually pushed back in the axial direction by the return force of the coil spring 37, and the pressure receiver 36 engages with the next engagement recess 57 over the oblique guide surface 59 after the engagement projection 58. As the sliding shaft 34 moves, the switching gear 35 attached thereto is disengaged from the nose-driving gear 38 and the connection to the nose-driving gear 38 is released. When the sliding shaft 34 pushes against the coil spring 37 while the receiver 36 of the sliding shaft 34 engages with the next engagement projection 58, the nose 12 repeats the above motion.

Thus the toy shaped like a baby mouse moves its ears 9 forward and backward alternately and asynchronously, and its nose repeatedly appears as if it were drawing a long breath while it holds the feeder 76 shaped like a feeding bottle in its mouth as if drinking the milk provided.

During this time, if one of both of the ears 9 is prevented from moving because it is being held, the input gear 51, while moving forward and backward in the axial direction against the force of the coil spring 64, is connected to and rotated by the second output gear 49 of the gear-connecting mechanism 31 by the clutch gear 63 engaging with the clutch gear 61 of the cam plate 53. Accordingly, because the input gear 51 is unable to force the cam plate 53 to rotate together therewith when the cam plate 53 is prevented from rotating because the ears are being held, the driving mechanism of the toy 1 is not broken nor damaged, and its safety is assured.

Although a description thereof has been omitted from the above embodiment of the invention, a mechanism producing a voice can be installed if required, the mechanism being operated by the driving mechanism so that the toy produces a suitable imitative sound while it appears to be drinking milk.

The above embodiment of the present invention refers to a toy shaped like a mouse being fed with milk. However, the toy can be of any shape other than a mouse and the feeder can be of any shape other than a feeding bottle, and can be of any form corresponding to the shape of toy selected.

The shape and construction of the feeder is not limited to that shown in the drawings and, for instance, the terminal body need not be of a screw type but could be a rotary type with a hook so that the feeder can be removed simply by rotating it, and the terminals are not limited to the coil spring type but plate terminals are also possible.

[Effects of the Invention]

According to the present invention, the motion toy comprises a toy body containing a driving mechanism for driving a movement mechanism and has a fixed terminal on one side thereof, and a power feeder in a desired shape having a detachable terminal which can be electrically connected to the fixed terminal of the toy, the feeder being provided independently of the feeder, so that it is possible for the toy to not contain the feeder which would be one of the disadvantage making the whole of the toy larger. This makes it possible to reduce the total size of the toy as desired, to give it a pleasant touch simply and, even if the toy body and the feeder are provided separately, because power can be simply supplied to the motor of the driving mechanism by electrically connecting the fixed terminal attached to the driving mechanism of the toy to the connection terminal of the feeder, operate the movement mechanism as desired by the operation of the driving mechanism, and simply stop the movement mechanism by electrically separating the terminals from each other to cut off the power supply. As a result, because the toy can be made compact, it also becomes possible to provide a toy shaped like a small animal, such as a baby of a small animal, to create a charmingly shaped toy, to give it a soft animal and form the toy as if it were holding a feeding bottle in its mouth and drinking milk from it, by shaping a power feeder like a feeding bottle when the toy is shaped like the baby of a small animal. Since it is necessary for the child playing with the toy and the feeder to move them together and separate them, the toy is more interesting to handle and operate. Accordingly, this is an very interesting toy which is very marketable.

What is claimed is:

1. A mammal motion toy characterized by comprising a holding toy body (1) shaped like a baby of a small animal having a head (2), a trunk (3), ears (9), a nose (12) and a mouth (13) with a fixed electric terminal (28), and a power feeder (76) provided independently of said toy body (1), shaped like a cylindrical feeding bottle having therein batteries (87) and an electric connection terminal (79) connectable removably with said fixed electric terminal (28) and shaped as a mouthpiece similar to a teat, said toy body (1) being coated with a soft napped coat (4) so napped that it feels like a baby of a small animal, said head (2) having therein a head frame (17) for holding the shape of the head, said head frame (17) having therein a first cam plate (52) contacting a linkage connected to a first ear and a second cam plate (53) contacting a linkage connected to a second ear for moving reciprocally and irregularly said ears (9), a crank shaft (41) connected to said nose for extending and retracting said nose (12), and an electric motor (19) connected to a gear train driving said crank shaft (41) and said first and second cam plates (52), (53), said electric motor (19) being connected electrically with said fixed electric terminal (28), and said trunk (3) being formed into a soft resilient bag (5) having therein finely chopped pieces of synthetic resin (16).

2. A mammal motion toy as claimed in claim 1, wherein said first and second cam plates (52), (53) arranged in said head frame (17) are fixed on both end portions of a driving shaft (50), a roughly rhombic peripheral engagement surface (54) engaging with an engagement piece (68) for oscillating one of said ears (9) is formed on said first cam plate (52), and a roughly triangular engagement surface (56) engaging with an engagement piece (68) for oscillating the other of said ears (9) is formed on said second cam plate (53), said driving shaft (50) being connected to said electric motor (19) through a gear-connecting mechanism (31).

3. A mammal motion toy as claimed in claim 1, wherein said crank shaft (41) arranged in said head frame (17) is mounted rotatably at one end thereof on a nose frame (45) connected to said nose (12) and movable up and down, and mounted rotatably at the other end thereof on one end of a lateral rod (39) having a nose-driving gear (38), said nose-driving gear (38) being meshed intermittently with a switching gear (35) connected to said electric motor (19) through a gear-connecting mechanism (31).

4. A mammal motion toy as claimed in claim 2, wherein said crank shaft (41) arranged in said head frame (17) is mounted rotatably at one end thereof on a nose frame (45) connected to said nose (12) and movable up and down, and mounted rotatably at the other end thereof on one end of a lateral rod (39) having a nose-driving gear (38), said nose-driving gear (38) being meshed intermittently with a switching gear (35) connected to said electric motor (19) through said gear-connecting mechanism (31).

5. A mammal motion toy as claimed in claim 3, wherein said switching gear (35) connected intermittently with said crank shaft (41) through said nose-driving gear (38) is fixed on a sliding shaft (34) urged by a spring (37), and a pressure receiver (36) formed at one end of said sliding shaft (34) is engaged with engaging recesses and projections (57), (58) formed on said second cam plate (53) for driving said ears (9), so that said switching gear (35) is moved forward and backward by the rotation of said engaging recesses and projections (57), (58) through said sliding shaft (34) which is moved forward and backward against said spring (37).

6. A mammal motion toy as claimed in claim 4, wherein said switching gear (35) connected intermittently with said crank shaft (41) through said nose-driving gear (38) is fixed on a sliding shaft (34) urged by a spring (37), and a pressure receiver (36) formed at one end of said sliding shaft (34) is engaged with engaging recesses and projections (57), (58) formed on said second cam plate (53) for driving said ears (9), so that said switching gear (35) is moved forward and backward by the rotation of said engaging recesses and projections (57), (58) through said sliding shaft (34) which is moved forward and backward against said spring (37).

* * * * *